United States Patent [19]

Kartiala

[11] 4,073,286

[45] Feb. 14, 1978

[54] SAUNA HEATER

[76] Inventor: Tauno F. Kartiala, 15836 Lahey St., Granada Hills, Calif. 91344

[21] Appl. No.: 714,578

[22] Filed: Aug. 16, 1976

Related U.S. Application Data

[63] Continuation of Ser. No. 603,713, Aug. 11, 1975, abandoned.

[51] Int. Cl.[2] ..... F24H 1/00

[52] U.S. Cl. ..... 126/344

[58] Field of Search ..... 126/344; 4/160; 128/367

[56] References Cited

U.S. PATENT DOCUMENTS

| | | | |
|---|---|---|---|
| 2,247,304 | 6/1941 | Mela | 126/344 |
| 2,557,656 | 6/1951 | Hedlund | 126/344 |
| 3,022,782 | 2/1962 | Bryant | 126/344 |
| 3,151,615 | 10/1964 | Siniaho | 126/344 |

FOREIGN PATENT DOCUMENTS

| | | | |
|---|---|---|---|
| 66,296 | 6/1943 | Norway | 126/344 |

*Primary Examiner*—John J. Camby
*Assistant Examiner*—Larry I. Schwartz
*Attorney, Agent, or Firm*—Matthew P. Lynch

[57] ABSTRACT

Provided is a sauna heater comprising an upright casing including an upper open receptacle for rocks to be heated and a burner at the bottom of the casing. An air intake communicates with the burner for the supply of air thereto. A heat deflector plate of planar configuration is disposed in the path of the gases within the combustion chamber and such that gases from the burner past the plate end and onto the top and thence downwardly toward a flue. The top of the burner is provided with an arcuate cover plate supporting the piled rocks. Upon heating the rocks, water is poured thereon to provide steam at a desired level. Excess water not absorbed by the heated rocks is drained in a free flow from the cover plate and directed to passage ways isolated from the combustion chamber and extending from the extremities of the cover plate to a point well below the bottom of the burner.

16 Claims, 2 Drawing Figures

SAUNA HEATER

This is a continuation of application Ser. No. 603,713 filed Aug. 11, 1975 now abandoned.

BACKGROUND OF THE INVENTION

The present invention relates to a furnace, stove or the like sauna heating-apparatus.

As is well known in the art, sauna heaters commonly employ a combustion chamber in which heat-interchange takes place between rocks piled on top of the burner and gases directed upwardly toward the top of such burners. An air intake or channel communicates the atmosphere with the burner, typically a gas burner, so as to supply air thereto. Products of combustion rise in the combustion chamber upwardly and, upon heat exchange with the rock-carrying top, are directed to a flue. Upon heating the rocks to a desired temperature, water is poured onto the rocks to thereby provide steam, the steam intensity corresponding to the degree of heating of the rocks.

A problem quite frequently encountered with such sauna heaters resides in the manner in which excess water not absorbed by the heated rocks, is drained or discharged from the heating devise. Although in many prior art devices drain pipes are provided to dispose of excess water, it has been found that in many instances such drain systems are inadequate in that residue water accumulated in deep corners of the heating device cannot be removed by the systems available. Inherently, deep corners are the most vulnerable places in which thermal cracks may occur.

Another serious and common problem encountered is the cracking of the sauna heater top when the latter has been heated to a high temperature and water is poured thereon. In the absence of adequate water drainage systems, such cracking causes thermal shock to the metal involved which, eventually, fractures such metal tops of the heater. Moreover, once such a top is cracked and fractured, the possibility is great that poisonous combustion gases may enter the sauna room.

SUMMARY OF THE INVENTION

Object of the invention is to overcome the above disadvantages and to provide a sauna heater which incorporates a novel drainage arrangement by which excess water is automatically discharged from the heating device without any residue water left in the device.

A further object of the invention is to provide an improved sauna heater incorporating means to prevent cracking or fracture of the sauna heater top upon heating of the latter to a high temperature and the subsequent pouring of water on rocks on such high heated tops.

According to the invention such a sauna heater comprises an upright body having an outer jacket, an upper and lower portion, and a combustion chamber bounded by the jacket intermediate the upper and lower portion of the heater body. A controllable gas burner is disposed in the lower body portion and extends in communication with an air intake for the supply of air to the gas burner. Positioned at a location adjacent the top of the burner body is a flue and a deflector plate having upper and lower planar surfaces is disposed in the path of the gases, the latter being directed upwardly toward the top of the burner body. Spaced a slight distance above the top of the body is an arcuately-shaped cover plate, the latter forming a support for rocks piled in the burner body top whereby, upon heating the air by the gas burner at the lower portion, the major draft of the burner is directed past the lower planar surface of the plate upwardly to the top of the burner body and, upon heat exchange with such top and the rocks supported on the cover plate, the draft is oriented downwardly over the opposite upper planar plate surface toward the flue. Upon heating the rocks to a desired, regulated temperature, water is poured into the heated rocks to provide steam. Excess water or water not absorbed by the rocks seeps through onto the curved cover plate and is drained from the burner system by way of water passage ways extending axially downwardly from the cover plate extremities, in a plane parallel to the axis of the burner and terminating into openings at a position well below the lower burner portion such that no residue water will remain in any given area of the burner body.

With the foregoing and other objects in view, which will be made manifest in the following detailed description, reference is had to the accompanying drawings for the illustrative embodiment of the invention.

DESCRIPTION OF THE PREFERRED EMBODIMENT

Figure 1:
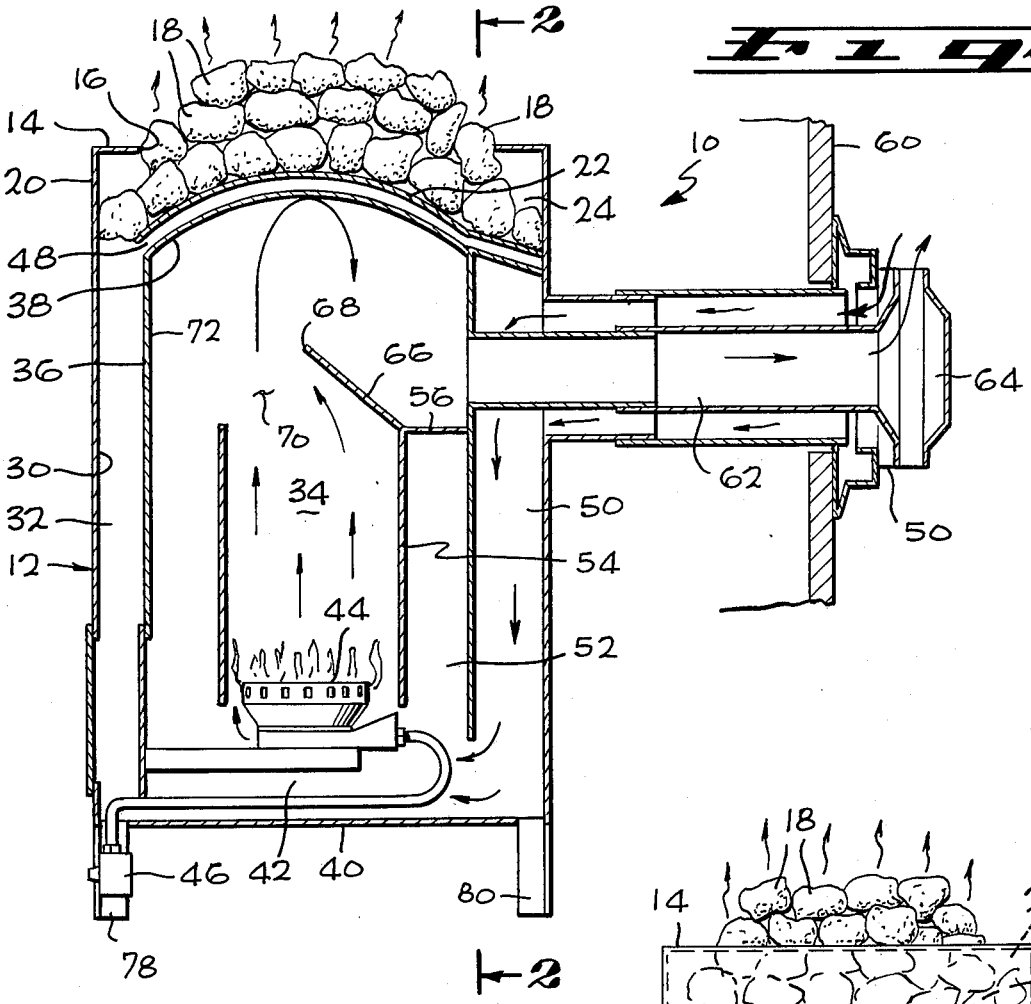
FIG. 1 is a sectional side view of the sauna heater of the invention, illustrating the burner in relation to a wall of the steam room.

Referring now to the drawings in which like reference numerals depict like parts and with attention initially directed to FIG. 1, there is shown a sauna heater 10 arranged to provide a steam room with an elevated temperature, e.g., in excess of 100° F.

The heater 10 is seen to comprise an outer jacket or casing 12 which may be of cast iron or sheet metal and, preferably, is rectangular in transverse sectional view. The jacket 12 is provided with an upper planar top 14 having formed therein an opening 16, the latter enabling rocks 18 to be piled at the upper portion 20 of the heater. Fixed within jacket 12 at upper portion 20 thereof is an arcuately-shaped shield member 22. The member 22 and the planar top 14 are dimensioned such as to form a pocket 24 within the heater upper portion 20 in which rocks 18 are piled for quick heating, as will be explained hereafter.

Figure 2:
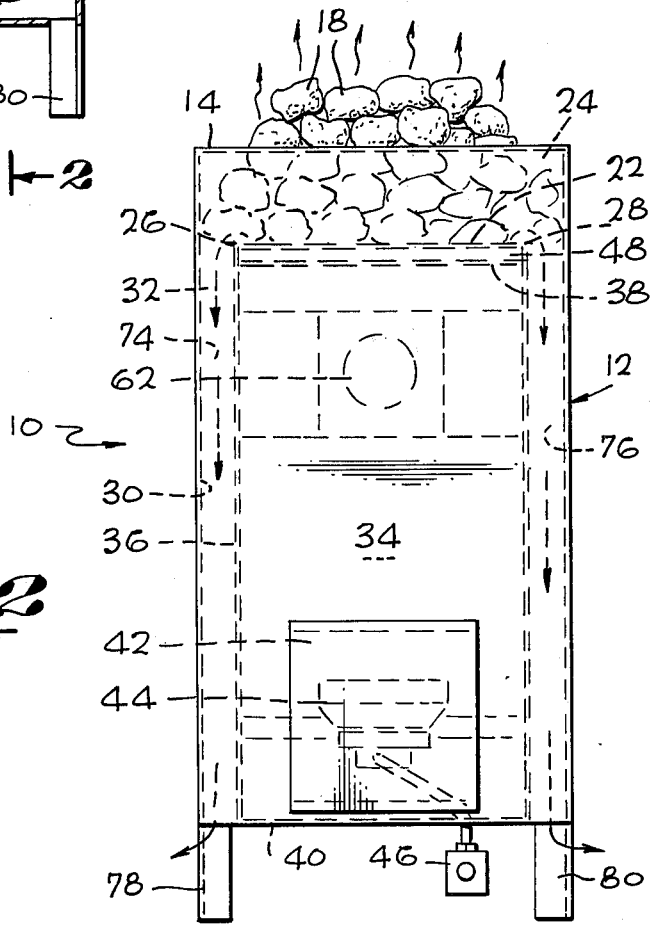
FIG. 2 is a cross-sectional view of the sauna heater of FIG. 1, the section being taken along the line 2—2 of FIG. 1.

As clearly shown in FIG. 2, the extremities 26, 28 of shield number 22 are spaced a slight distance from the jacket inner wall 30 as to define there with a passage 32.

The interior of the heater is formed into a combustion chamber 34 bounded at its sides by walls 36, a top 38 and bottom 40. The bottom 40 is formed with a fire chamber 42, FIG. 2, including a main gas burner 44, the latter being controlled, in the usual manner, by a gas control system 46. The combustion chamber top 38 is slightly spaced from shield member 22 so as to avoid direct contact therewith and overheating of the top 38 during heat exchange of the latter with the member 22. The spacing 48 is dimensioned such, however, that when the rocks 18 are piled through the opening 16 onto the shield member 22, heat emanating from the gas burner 44 and directed upwardly toward the top 38, is quickly interchanged with the rocks 18 over substantially the surface area of shield member 22 for steam generating. The rocks 18 are sufficiently large to prevent them from dropping into the passage 32.

Provided directly below upper portion 20 of the heater is an air intake 50 and leads downwardly toward the heater or fire chamber 42 to provide air for the combustion of the fuel. The combustion air flow through intake 50 is isolated from the combustion chamber 34 by an air space 52 bounded by walls 54, 56, of a fire-proof material. As shown, the air intake 50 is run from point 58 adjacent a wall 60 of the steam room, e.g., from a chamber adjacent the steam room.

Encompassing the air inlet section adjacent the burner top 20, is a flue 62 terminating in a vent opening 64 by positioned exteriorly of the steam room.

As will be appreciated, combustion gases formed in the fire chamber 34 pass, after heat exchange, through the flue 62 and escape through opening 64 to the atmosphere.

In the form of the device shown, a deflection plate 66 of fire-proof material if placed over or above the fire chamber 42 and is adapted to conduct combustion products, passing to the flue 62, over the upper end 68 of the plate. The plate, as shown, extends at an angle from the wall 54, in an upwardly oriented, forwardly inclined position to the flue 62 of the fire or combustion chamber. An opening 70 is formed between the upper end 68 of the plate and the rear wall 72 of the jacket 12.

The lower and upper surfaces of the plate are planar surfaces and these surfaces act as a guide to direct the combustion gases upwardly via the lower planar surface toward the top of the furnaces so that they pass through the opening 70 and, upon heat interchange, are deflected by the top 38 and, in association with the upper planar plate surface, then descend downwardly toward the flue 62.

The provision of the plate 66 provides an adequate means which minimizes the direct outflow of gases through the flue but, instead, provides the tendency for the gases to be directed toward the rear of the furnace and, subsequently, on impinging upon the bottom of top 38, the gases are liberated.

Extending axially from the passage 32 between the shield member extremeties 26, 28 and the jacket wall 30, are vertically downwardly oriented passage ways 74, 76, the latter having an axis parallel with the main burner axis and, terminate at their lower ends at a location below the burner bottom 40. The passage ways 74, 76 may be of suitable cross-sectional configuration and their lower extremities may terminate into open leg portions or containers 78, 80.

In operation the burner 44 is lit and air for combustion is drawn through the air intake 42. The products of combustion rise in the combustion chamber upwardly and via the plate 66, impinge against the bottom of chamber top 38. Water is poured onto the heated rocks 18 and steam is developed within the steam room, the degree of humidity being controllable by means of the controls 46 of the burner 44. Any water which does not evaporate as it passes over and through the heated rocks 18 will run off the upper curved surface of shield member 22, past the extremities 26, 28 and will drain through the passage ways 74, 76 to a point below the burner, e.g., the water may be collected in, e.g., containers or collected in any other suitable manner.

As will be appreciated, with the drainage system of the present invention, any accumulation or residue of water, e.g., in deep corners, is obviated by the positively free flow of excess water from a point above the combustion chamber to a point well below the bottom of the combustion chamber, i.e., the drainage system is totally isolated from the chamber.

It should be noted that the present disclosure is for the purpose of illustration only and that this invention includes all modifications and equivalents which fall within the scope of the appended claims.

I claim:

1. A sauna heater, comprising:

an upright housing having wall structure defining an inner combustion chamber within said housing, said chamber including a top, a bottom and opposite side walls;

a heating element at the bottom for producing combustion gases in said chamber in response to air conducted to said heating element;

air supply means including an air opening through one of said side walls at a position spaced downwardly from said top;

flue means including a flue opening concentrically with said air opening through said one of said side walls at said position spaced downwardly from said top;

rock supporting means carried by said housing at a position spaced upwardly from said top, said supporting means being adapted for indirect heat-interchange between said chamber top and rocks piled on said supporting means to provide steam;

a gas flow conducting element disposed in the path of the ascending gas flow in said chamber on an angle inclined upwardly from said one side wall and having a free edge defining a passageway for gases between said element and an opposite one of said side walls so that the major draft of said heating is directed past said edge and onto said top and thence toward said flue opening; and drainage means extending axially downwardly from said rock supporting means, laterally and freely spaced from said combustion chamber to a point below said housing to discharge unabsorbed excess water.

2. The Sauna heater of claim 1, wherein said gas flow conducting element comprises a plate member having parallel planar upper and lower surfaces are parallel opposite edges with the upper most edge of said plate member being spaced from said top and said opposite one of said wide walls and the lower most edge of the plate being disposed adjacent the lower edge of said flue opening so that combustion gases are directed by the lowermost planar surface, past the uppermost edge and thence downwardly to the flue.

3. The Sauna heater of claim 1, wherein said rock supporting means comprises parallel opposite edges with one of said edges secured to said housing adjacent the upper edge of said flue and the other ones of said edges forming free ends spaced from said combustion chamber and defining channels therebetween communicating the top of said supporting means with said drainage means.

4. The Sauna heater of claim 3, wherein said rock supporting means is of generally arcuate configuration with the concave side of said supporting means facing said combustion chamber top.

5. The Sauna heater of claim 4, wherein said combustion chamber top is of generally arcuate configuration and to with the convex side thereof facing the concave said of said supporting means.

6. The Sauna heater of claim 5, wherein said combustion chamber top is of a dimension and configuration generally corresponding to that of said supporting means.

7. The Sauna heater of claim 6, wherein said rock supporting means is an arcuately shaped plate member having outer extremeties thereof communicating with said drainage means, the latter extending downwardly from the plate member extremities, axially parallel to the axis of said heater.

8. The Sauna heater of claim 6, wherein said heater includes upright side walls isolating said drainage means along a vertical axial axis from said chamber.

9. The Sauna heater of claim 8, wherein said drainage means are in the form of at least one channel extending axially downwardly from the extremities of said plate member.

10. The Sauna heater of claim 8, wherein said drainage means are in the form of a plurality of channels extending axially downwardly from the extremities of said plate member.

11. The Sauna heater of claim 8, wherein said drainage means extends in surrounding relation to said chamber.

12. The Sauna heater of claim 11, wherein said drainage means include an upper end and a lower end, said upper end extending from said extremities of said plate member and said lower end communicating of said member with the atmosphere.

13. The Sauna heater of claim 12, wherein said lower end is in the form of a reservoir.

14. The Sauna heater of claim 13, wherein said drainage means includes an upper section open to the atmosphere and a lower section having opening open to the atmosphere.

15. The Sauna heater of claim 14, wherein said drainage means are channel means isolated from the heater body such that no water will enter any given area of the heater body.

16. The Sauna heater of claim 1, wherein said heating element is a gas heater.

* * * * *